US011047656B2

(12) United States Patent
Brock

(10) Patent No.: US 11,047,656 B2
(45) Date of Patent: Jun. 29, 2021

(54) DEEP GROOVE PROJECTILE WITH LEADING CONVEX SURFACE FOLLOWED BY ABRUPT ANGLE SURFACE

(71) Applicant: Charles Brock, Plant City, FL (US)

(72) Inventor: Charles Brock, Plant City, FL (US)

( * ) Notice: Subject to any disclaimer, the term of this patent is extended or adjusted under 35 U.S.C. 154(b) by 0 days.

(21) Appl. No.: 16/433,493

(22) Filed: Jun. 6, 2019

(65) Prior Publication Data

US 2019/0383591 A1 Dec. 19, 2019

Related U.S. Application Data

(60) Provisional application No. 62/684,970, filed on Jun. 14, 2018.

(51) Int. Cl.
*F42B 10/02* (2006.01)

(52) U.S. Cl.
CPC ..... *F42B 10/02* (2013.01)

(58) Field of Classification Search
CPC ..... F42B 12/74; F42B 10/00; F42B 10/22; F42B 10/42; F42B 10/02
See application file for complete search history.

(56) References Cited

U.S. PATENT DOCUMENTS

2017/0080498 A1* 3/2017 Burrow ..... C22C 38/04
2017/0268858 A1* 9/2017 Morse ..... F42B 12/367
2019/0017789 A1* 1/2019 Burczynski ..... F42B 12/74

* cited by examiner

*Primary Examiner* — J. Woodrow Eldred
(74) *Attorney, Agent, or Firm* — Bennet K. Langlotz; Langlotz Patent & Trademark Works, LLC

(57) ABSTRACT

A firearm projectile is provided to promote a yaw effect on material entry by the projectile and to enhance wound channel formation on entered material. The firearm projectile comprises an elongated body, having a surface formed as a surface of revolution. It further consists of an ovoid forward portion and a cylindrical rear potion.

1 Claim, 8 Drawing Sheets

DEEP GROOVE PROJECTILE WITH LEADING CONVEX SURFACE FOLLOWED BY ABRUPT ANGLE SURFACE

CROSS-REFERENCE TO RELATED APPLICATIONS

This application claims the benefit of U.S. Provisional Patent Application No. 62/684,970 filed on Jun. 14, 2018, entitled "DEEP GROOVE PROJECTILE WITH LEADING CONVEX SURFACE FOLLOWED BY ABRUPT ANGLE SURFACE", which is hereby incorporated by reference in its entirety for all that is taught and disclosed therein.

FIELD OF THE INVENTION

The present invention relates to a firearm projectile, and more particularly to an application of deep groove to projectile with a leading convex surface followed by an abrupt angle surface. The purpose of this invention is to promote a yaw effect on material entry by the projectile to enhance wound channel formation on entered material.

SUMMARY OF THE INVENTION

The present invention relates to the application of a deep concentric groove to a projectile which promotes stability of flight characteristics during flight path in gas medium. The same groove promotes hydrostatic disruption when the projectile enters a fluid or tissue medium. This promotes the transfer of kinetic energy from the projectile to tissue medium. It disrupts the linear pathway which causes the projectile to change direction and as such increases the surface area moving in forward direction. This further promotes a hydrostatic force, the transfer of kinetic energy. This energy transfer can result in fragmentation of the projectile with separation of the section following the groove leading to separation of the projectile into fragment (s). This creates secondary, tertiary, etc. fragments that create further wound channels, transfer of kinetic energy.

The projectile may be any caliber of length D and width E. The overall diagram represents a cross section of the projectile. One or more grooves may be applied to the projectile. This groove is defined by a leading convex curve A cut into projectile in a curvilinear fashion. The length of A is variable based on the overall projectile size. The depth of the groove is defined by C. C may not exceed one-half of E, and C is at least one-tenth of E. B is the width of the remaining section between the projectile nose and base. The angle between A and C will not exceed 90 degrees. The diameter of the first portion of projectile (G) will match the bore diameter of the caliber barrel. The diameter of the second (third, etc.) section (H) will match the groove diameter of the caliber barrel. In doing so, the projectile minimizes the surface area in full contact with the barrel by the front portion of the projectile but creates a complete gas seal by the rear portion of the projectile to maximize the efficiency of propellant gas. This reduces the chamber pressure and the barrel pressure and permits a higher velocity of the projectile to be obtained.

The distance F will be greater than zero but less than C. The degree of convexity of A can be adjusted for maximum efficiency of air or fluid dynamics based on caliber (size) of the projectile.

The result of the projectile groove is to produce an aero or fluid dynamic drag, and induce a yaw effect which results in projectile tumbling, changing direction, transferring kinetic energy, inducing hydrostatic force and otherwise increased wound channel formation. While the base of the projectile may separate from the nose portion, the projectile is not intentionally designed to cause separation.

Multiple grooves can be applied to a given projectile to multiple effect.

DETAILED DESCRIPTION OF A PREFERRED EMBODIMENT

Figure 1:
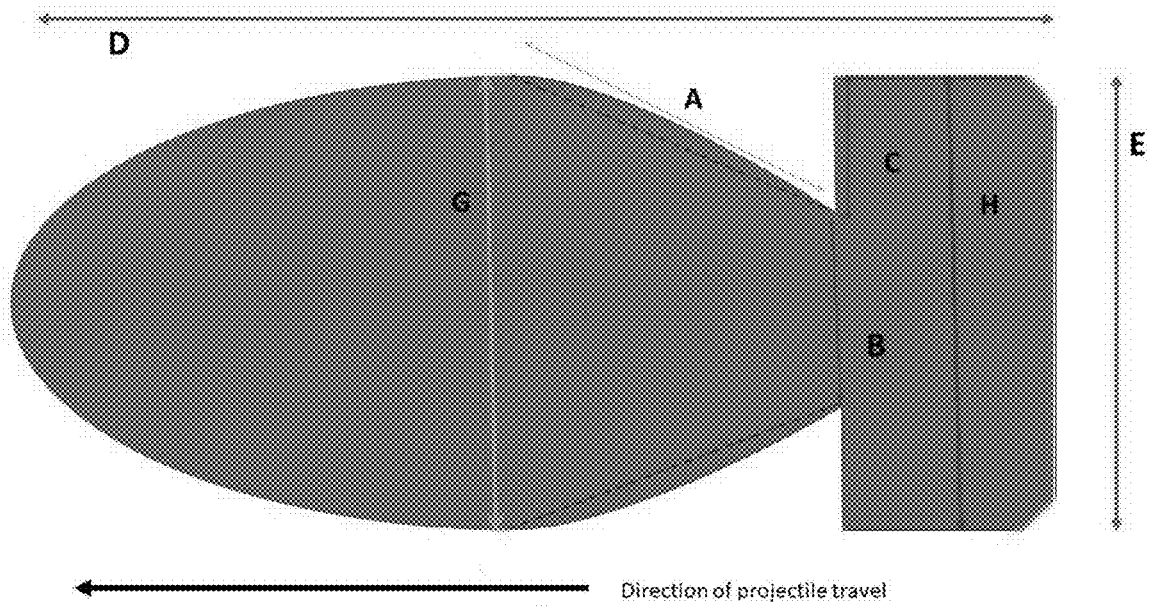
FIGS. 1-8 show various views of a preferred embodiment of the invention.

FIG. 1 is a cross section diagram of the projectile with markings noting various measures of the projectile.

Figure 2:
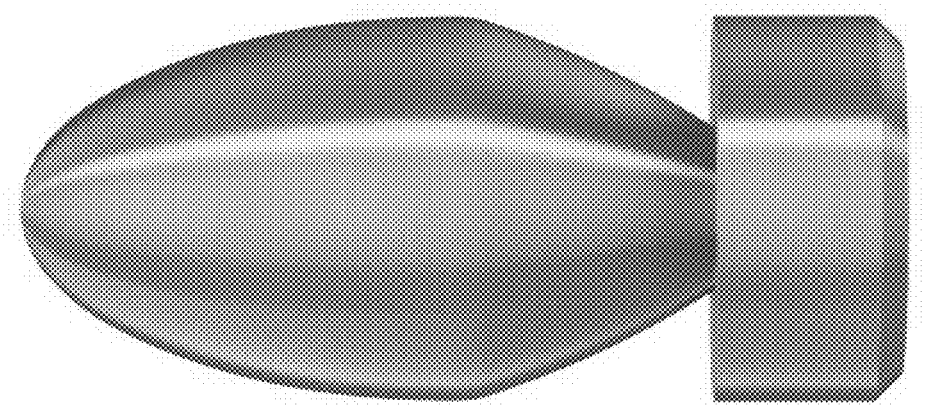

FIG. 2 shows a 3D side rendering of an example projectile (FIG. 1).

Figure 3:
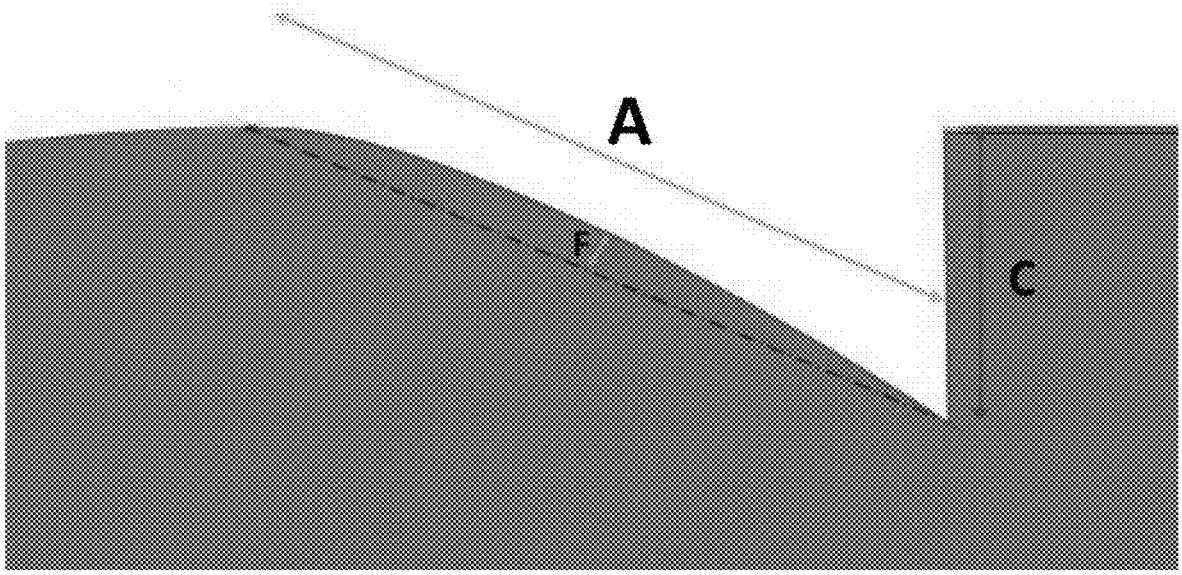

FIG. 3 is a close up drawing of the groove portion of the projectile with measure labels.

Figure 4:
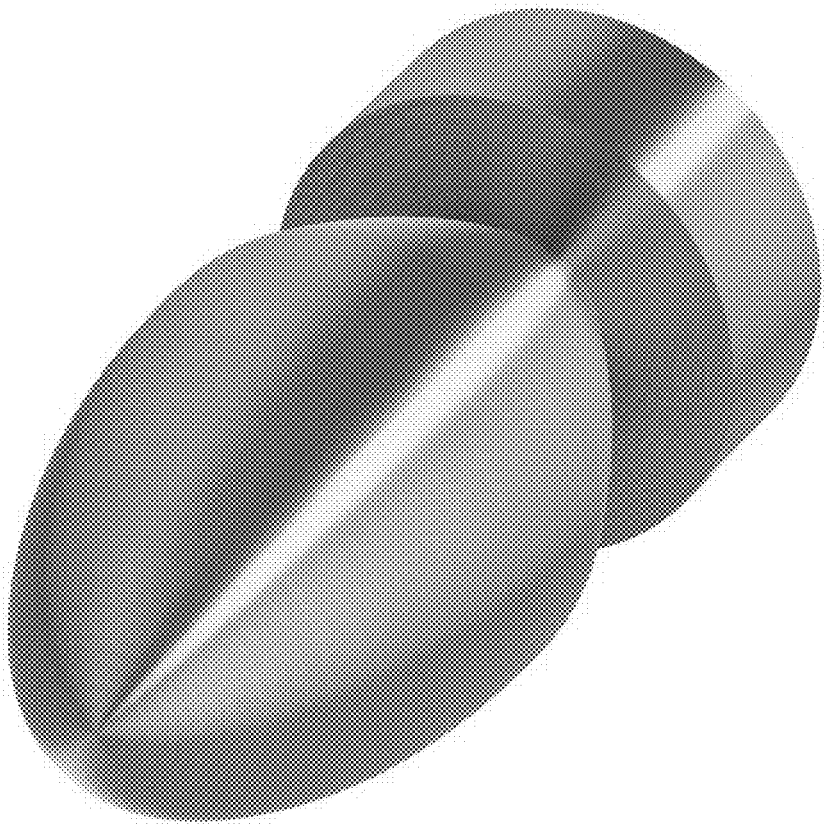

FIG. 4 shows a 3D longitudinal rendering of an example projectile (FIG. 1).

Figure 5:
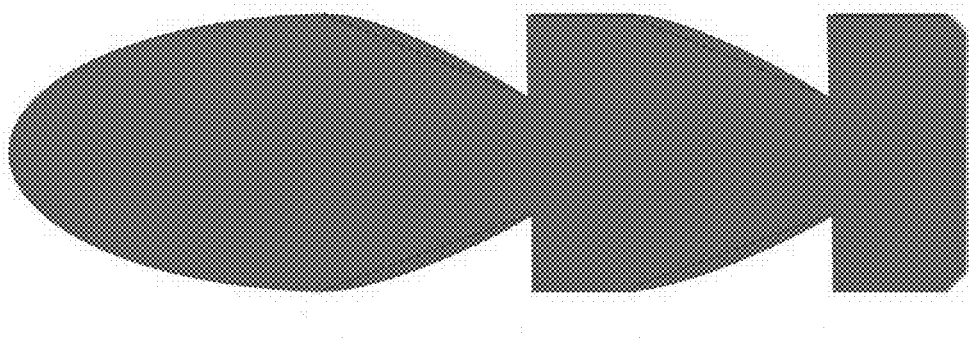

FIG. 5 is a cross section diagram of a projectile with two applied grooves.

Figure 6:
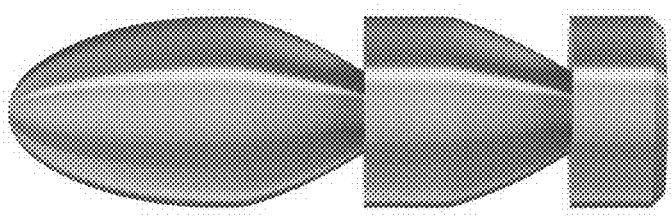

FIG. 6 shows a 3D side rendering of an example projectile (FIG. 5).

Figure 7:
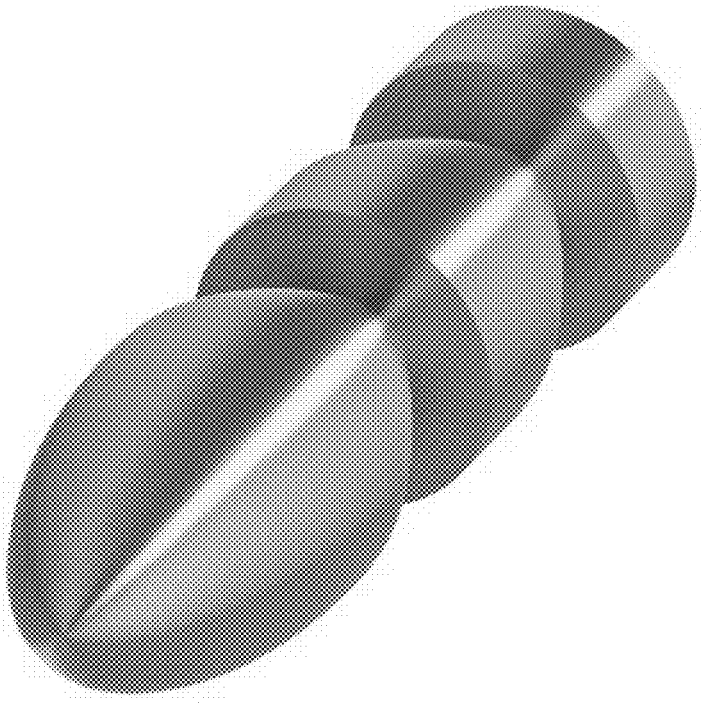

FIG. 7 is a 3D longitudinal rendering of an example projectile (FIG. 5).

Figure 8:
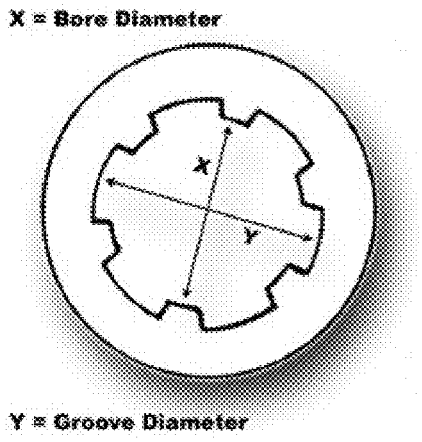

FIG. 8 is an illustration diagram of a cross section of a barrel showing a bore diameter and a groove diameter.

I claim:

1. A firearm projectile comprising:

an elongated body having a surface formed as a surface of revolution;

the elongated body having a generally ovoid-shaped forward portion pointing in the direction of projectile travel;

the elongated body having a generally cylindrical rear portion having a forward-facing face attached behind the generally ovoid-shaped forward portion; and the generally ovoid-shaped forward portion having a reduced diameter portion adjacent to the generally cylindrical rear portion.

* * * * *